US005086812A

United States Patent [19]

Van Bogaert et al.

[11] Patent Number: 5,086,812

[45] Date of Patent: Feb. 11, 1992

[54] WEFT THREAD SUPPLYING DEVICE WITH ROTARY THROTTLE VALVE IN AIRJET WEAVING MACHINES

[75] Inventors: Philippe Van Bogaert, Schaarbeek; Jean-Marie Bamelis; Jozef Peeters, both of Ieper; Hugo Markey, Langemark, all of Belgium

[73] Assignee: Picanol N.V., naamloze vennootschap, Belgium

[21] Appl. No.: 655,156

[22] Filed: Feb. 14, 1991

[30] Foreign Application Priority Data

Feb. 15, 1990 [BE] Belgium ..... 09000169

[51] Int. Cl.[5] ..... D03D 47/30

[52] U.S. Cl. ..... 139/435.2

[58] Field of Search ..... 226/97; 251/129.11, 251/129.04, 208, 209; 139/435.2

[56] References Cited

U.S. PATENT DOCUMENTS 3,672,406 6/1972 Vermeulen ..... 139/435.2
4,102,361 7/1978 Tanaka et al. .
4,303,106 12/1981 Yoshida et al. .
4,673,005 6/1987 Kawajini ..... 139/435.2
4,722,370 2/1988 Manders ..... 139/435.2 X
4,732,179 3/1988 Takegawa .
4,813,460 3/1989 Van Bogaert et al. .

FOREIGN PATENT DOCUMENTS 904984 12/1986 Belgium .
0189919 8/1986 European Pat. Off. .

*Primary Examiner*—Andrew M. Falik
*Attorney, Agent, or Firm*—Bacon & Thomas

[57] ABSTRACT

A device for supplying weft threads in airjet weaving machines includes at least one nozzle connected to a compressed air source, a buffer tank, a cutoff valve placed in a funnel between the compressed air source and the nozzle, and a controlled throttling device. The throttling device is mounted downstream from the buffer tank and in the immediate surroundings of the cutoff valve, and includes the funnel, a rotary throttling element, and a motor for rotating the throttling element. The funnel is divided into an inlet funnel and an outlet funnel connected to the inlet funnel. The rotary throttling element fits within the inlet funnel and rotates to selectively block an entry to the outlet funnel according to the degree of rotation of the throttling device.

16 Claims, 4 Drawing Sheets

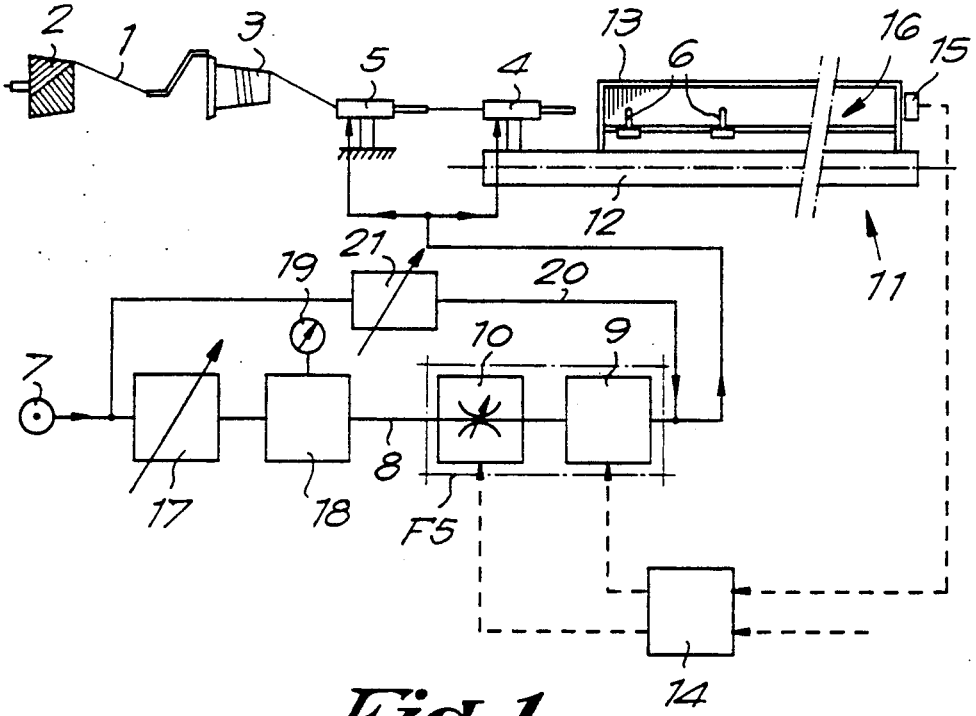
Fig. 1
Fig. 2
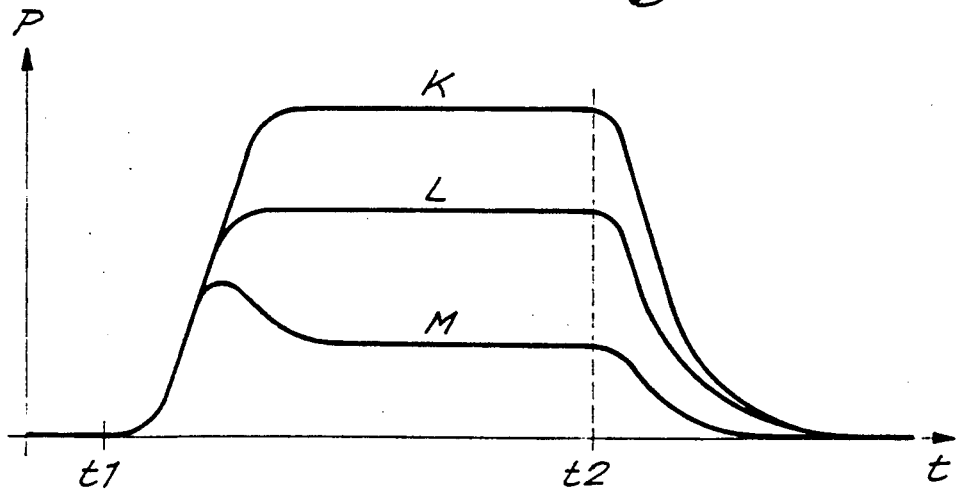

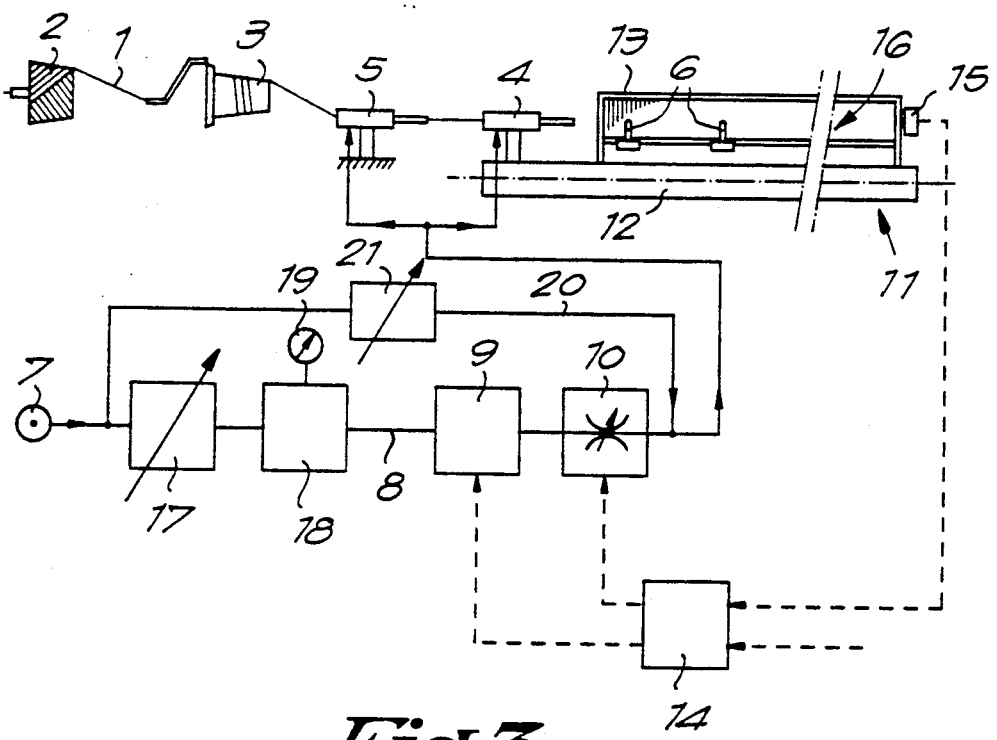
Fig. 3
Fig. 4
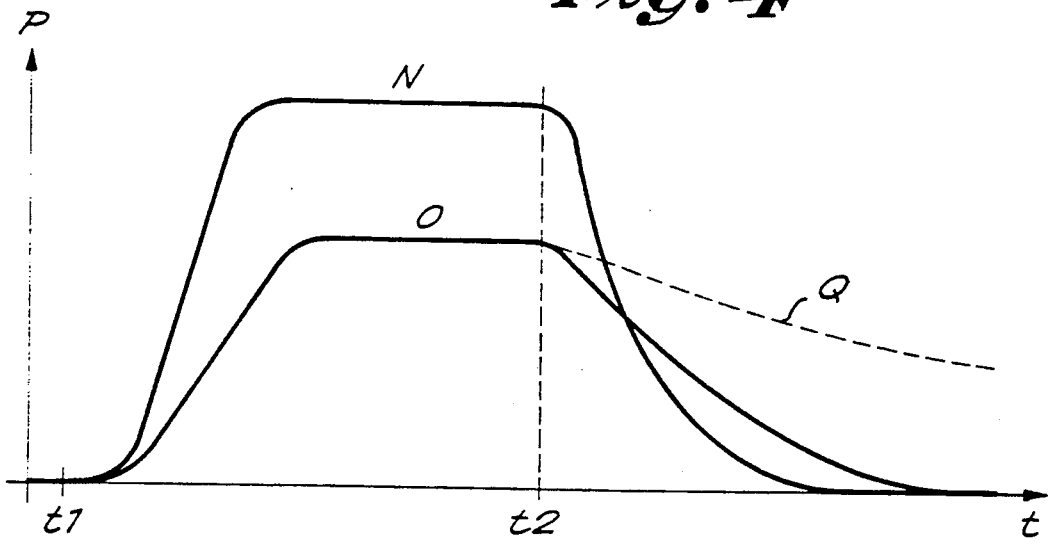

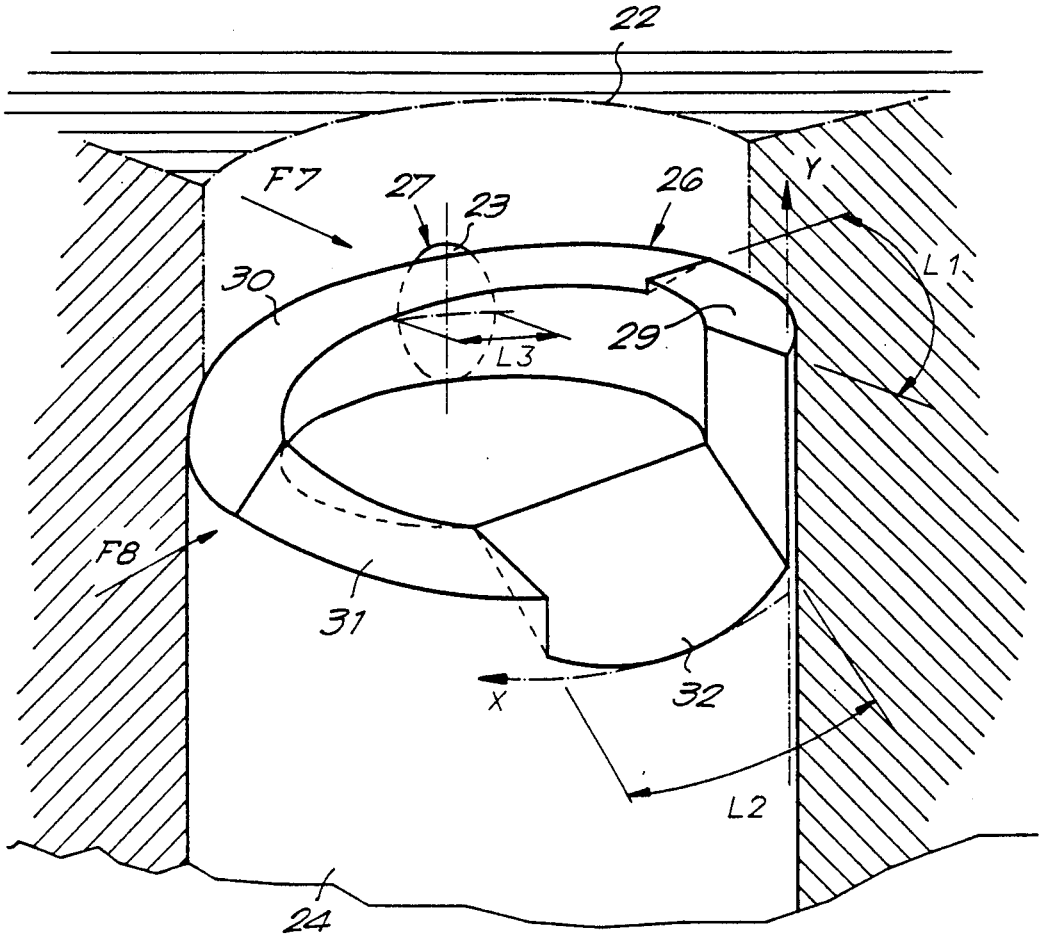
Fig. 6
Fig. 7
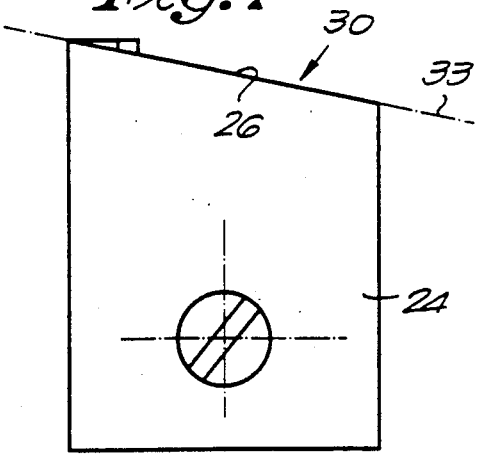
Fig. 8
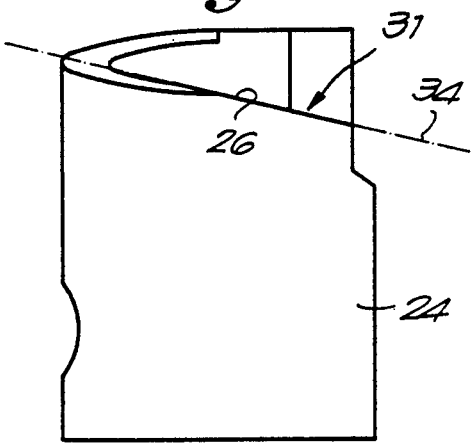

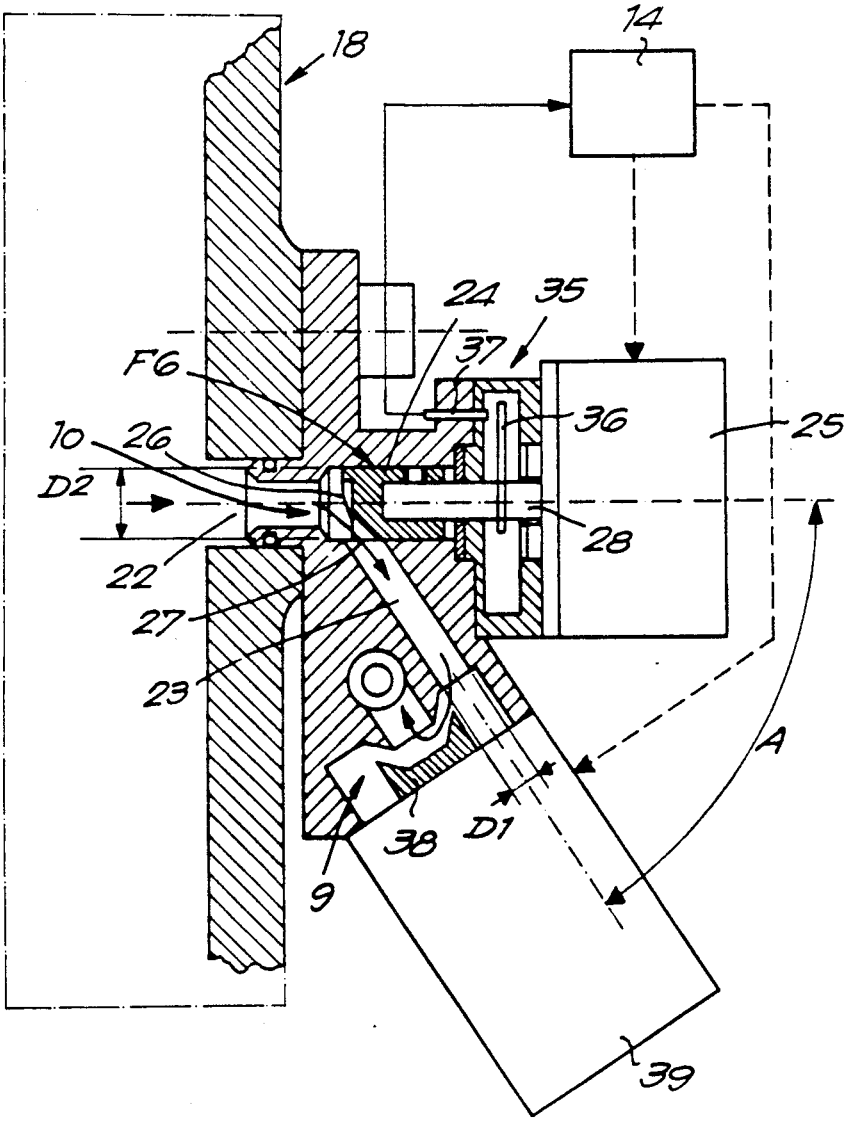
Fig. 5
Fig. 9
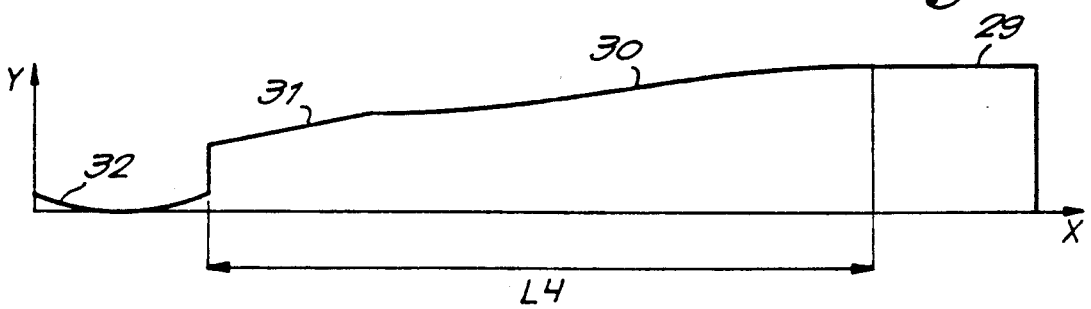

WEFT THREAD SUPPLYING DEVICE WITH ROTARY THROTTLE VALVE IN AIRJET WEAVING MACHINES

BACKGROUND OF THE INVENTION

This invention concerns a device for supplying weft thread in airjet weaving machines.

It is known that in airjet weaving machines the weft threads are inserted in the shed by means of a number of nozzles, such as a main nozzle, an auxiliary main nozzle and relay nozzles.

It is also known that in such airjet weaving machines the supply of air is adjusted as a function of measurements carried out on the weft threads, in order to let the insertion of each weft thread happen in optimum circumstances. To this end the nozzles mentioned above are connected to a compressed air source via one or more cutoff valves, whereby the cutoff valves are opened and/or shut off sooner or later in the weaving cycle as a function of the values measured and parameters entered. In order to influence the insertion behaviour of the weft thread very precisely, foremost to modify the moment of arrival of the weft thread, it is also known to throttle the supplied air by means of a controlled throttling element. An example of such a device is described in the Belgian patent No. 904.260. The insertion of the weft threads is done by means of a main nozzle moving along with the sley and an auxiliary main nozzle mounted fixed in front of the latter, whereby the blow air in the auxiliary main nozzle is throttled. To this end, the auxiliary main nozzle has a cone and a countercone which both fit into each other and between which the blow air can be conducted. One of the cones can be moved, or respectively removed from the other, such that the passage of the blow air can be modified.

Practical experience has shown that the use of an auxiliary main nozzle according to BE 904.260 for the present state of the art, with the ever-increasing machine speeds and the ever-extending range of yarn, leaves too little variation to modify the moment of arrival of the weft threads in relation to the weaving cycle. Current possible variations appear to take 8 to 14 milliseconds in a practical embodiment.

As throttling of the blow air according to the Belgian patent No. 904.260 is done with a throttling element which is inseparable from the auxiliary main nozzle, the blow air is throttled exclusively in the fixed auxiliary main nozzle, as a result of which a higher flow is led to the movable main nozzle during the throttling, resulting in greater traction here, which has a partly counter-productive effect.

The fact that the throttling is done on only one of the two main nozzles has the effect that, after the cutoff valve is shut off, all compressed air still present in the pipe between the cutoff valve and the main nozzles must escape through a smaller total opening, as a result of which the blow after effect after the moment that the cutoff valve is shut off, is extended.

It is also known that between the insertion periods of the weft threads a permanent airstream is provided in the main nozzles at low pressure, in order to hold the thread end present in said main nozzles. When the blow air is throttled in one of the main nozzles, this also causes the already low amounts of compressed air for holding the weft thread in the nozzles to be throttled even more.

Also, devices are known whereby the pressure of the blow air is controlled in the air receiver or buffer tank of the weaving machine. However, this technique has the disadvantage that each set pressure modification only shows after several insertions. It is therefore impossible to make adjustments during the insertion of a weft thread in order to modify the behaviour of this weft thread.

SUMMARY OF THE INVENTION

The present invention concerns a device for supplying weft thread in airjet weaving machine, whereby the disadvantages mentioned above are excluded. Indeed, the present invention concerns a device whereby the throttling of the air supplied to the nozzles allows a larger scope of adjustment of the moment of arrival of weft threads in the weaving cycle, namely double or more of the value reached previously, and whereby the throttling is made independent of the nozzles.

The present invention also concerns a device for supplying weft threads whose throttling device is very compact.

Another aim of the invention is to obtain very short reaction times between the activation of the nozzles on the one hand, and the blow action at the exit of the nozzles on the other hand, by both a specially adapted arrangement of the throttle device and by the use of a well-defined throttle device.

According to a special embodiment the invention concerns a device for supplying weft thread, which makes use of a throttle device driven by means of a stepper motor, whereby the throttle device is constructed such that the time of arrival of the weft thread at the end of the shed is a linear function of the rotation of the step motor.

In order to reach the set goals, the invention concerns a device for supplying weft thread in airjet weaving machines, including at least one nozzle connected to a compressed air source, and a buffer tank placed in the pipe between the compressed air source and the nozzle, a cutoff valve, and a controlled throttling device, wherein the throttling device is mounted after, i.e., dowstream of, the buffer tank and adjacent to or in the immediate surroundings of the cutoff valve, and includes an inlet funnel, an outlet funnel connected to the latter, a rotary throttling element fitting in the inlet funnel, and a motor to rotate the throttling element. As the throttling device is located after the buffer tank and in the immediate surroundings of the cutoff valve, even shorter reaction times are obtained, as further described below, and this effect according to the invention is reinforced by combining it with a throttling device using a rotary throttling element which allows any desired modification of the width of passage to be realized almost instantaneously.

The best results are obtained when the throttling device is mounted after the buffer tank and immediately before, i.e. upstream of, the cutoff valve.

Preferably, the throttling element is cylindrical and has at its top surface a profiled edge which operates in conjunction with the entry of the outlet funnel.

The throttling element may be either a solid or a hollow cylinder. The hollow cylinder has the advantage that the short reaction time is reduced even more, because the motor needs only to rotate a very light mass. As a result it becomes possible to influence the time of arrival of the weft thread within the pick.

In an especially preferred embodiment the profiled edge has such a shape that the time of arrival of the weft thread is a linear function of the rotation of the motor for a well-defined supplying pressure of the blow air. This effect may also be obtained by giving the entry of the outlet funnel a special shape.

When two nozzles are used at the entry of the shed, a main nozzle and an auxiliary main nozzle respectively, according to the invention the throttling device is placed preferably in the common supply pipe and mounted in the immediate surroundings and preferably before the cutoff valve, such that lengthy blow after effects are avoided.

BRIEF DESCRIPTION OF THE DRAWINGS

In order to explain the characteristics of the invention, by way of example only and without being limitative in any way, the following preferred embodiments are described with reference to the accompanying drawings, where:

FIG. 1 shows a schematic representation of a device according to the invention;

FIG. 2 shows the course of the nozzle air supply in the device in FIG. 1 for various positions of the throttling device;

FIG. 3 shows a variant of the device in FIG. 1;

FIG. 4 shows the course of the nozzle air supply in the device in FIG. 3 for various positions of the throttling device;

FIG. 5 shows a practical embodiment of the part indicated by F5 in FIG. 1;

FIG. 6 shows the part indicated by arrow F6 in FIG. 5, to a greater scale;

FIGS. 7 and 8 show views according to arrows F7 and F8 in FIG. 6, to a smaller scale than the view in FIG. 6;

FIG. 9 shows the shape of the edge of the element from FIG. 6 in its unwound state.

DETAILED DESCRIPTION OF THE PREFERRED EMBODIMENTS

As indicated in FIG. 1, a device according to the invention for supplying the weft thread 1 includes a supply package 2; a yarn storage feeder, such as an accumulator 3; a number of nozzles, in this case a main nozzle 4, an auxiliary main nozzle 5 and several relay nozzles 6; a compressed air source 7; and a cutoff valve 9 as well as a throttling device 10 in the pipe 8 between the compressed air source 7 and one or more of the nozzles mentioned above. In the embodiment shown only the main nozzle 4 and the auxiliary main nozzle 5 are connected to the cutoff valve 9 and the throttling device 10, while the relay nozzles 6 are controlled by separate valves, which are not shown.

FIG. 1 also shows the sley 11, including the sley shaft 12 and the reed 13 mounted on the latter. The main nozzle 4 operates in conjunction with the sley 11, while the auxiliary main nozzle 5 is fixedly mounted.

The cutoff valve 9 and the throttling device 10 are controlled by means of a control unit 14 as a function of several parameters, including for example the measured signal of a detector 15 which measures at the end of the shed the arrival of the weft threads for each weaving cycle, or a measured signal of any other detector operating in conjunction with the picking. Other examples are a winding detector at the accumulator 3, a bobbin transfer detector in case continuous weft thread supply is used, etc.

Between the compressed air source 7 on the one hand and the cutoff valve 9 and the throttling device 10 on the other hand, there is also mounted a pressure control 17 and an air receiver 18, also named buffer tank, with a pressure gauge 19, whereby the pressure control 17 is mounted upstream of the buffer tank 18. The nozzles 4 and 5 are permanently provided with low-pressure air via a supply pipe 20 in order to keep the end of the weft thread 1 in the nozzles 4 and 5 between the insertions. This supply pipe 20 provides blow air of 20 to 500 millibars and is connected to the compressed air source 7, for example, by means of a pressure control 21 and/or throttling valve.

According to the invention the cutoff valve 9 and the throttling device 10 are mounted in each other's immediate surroundings, such that the blow after effects mentioned above are almost completely excluded. In the most preferred embodiment the throttling device 10 as shown in FIG. 1 is mounted immediately before, i.e. upstream of, the cutoff valve 9.

As shown in FIG. 2 the throttling in the arrangement according to FIG. 1 has no negative effect on the pressure reduction after the cutoff valve 9 has been closed. Curve K shows the course of the pressure of the nozzle air supply when the throttling device 10 is fully opened, in other words when there is no throttling. The curves L and M show the course for two different positions of the throttling device 10, respectively for a small and a greater throttling. The times t1 and t2 indicate the moments at which the cutoff valve 9 is closed and opened respectively. The reduction times are almost equal in all three cases.

The pressure increase is as fast with throttling as without throttling. As indicated in curve M, the pressure increase for a stronger throttling may show a peak as a result of the volume present in the pipe between the throttling device 10 and the cutoff valve 9, where a pressure equal to the pressure before the throttling device 10 can occur after the cutoff valve 9 has been closed. In practice however, this pressure increase is not possible during the normal weaving process as a result of the speed of the weaving machine.

FIG. 3 shows a variant whereby the throttling device 10 is mounted in the immediate surroundings of the cutoff valve 9 in accordance with the invention, but whereby they have been mutually exchanged, contrary to the embodiment in FIG. 1. FIG. 4 shows the course of the pressure of the blow air in the curves N and O, respectively when there is throttling and when there is no throttling. To make a distinction, the curve Q is also included, illustrating the case wherein case the throttling device 10 is located at a great distance from the cutoff valve 9, for example when the throttling device is built into the nozzles 4 and/or 5, as is known from the BE 904.260.

In order to keep the reaction times to a minimum, use is made, according the invention, of a special construction for the throttling device 10, in combination with the fact mentioned above, i.e. that the throttling device 10 and the cutoff valve 9 are located in each other's immediate surroundings and preferably are supported in the same frame or integral unit as shown in FIG. 5. As indicated in FIG. 5, to this end the throttling device 10 includes an inlet funnel 22; an outlet funnel 23 connected to the latter; a rotary, cylindrical throttling element 24 fitting into the inlet funnel 22; and a motor 25 to rotate the throttling element 24.

Preferably, the inlet funnel 22 and the throttling element 24 are cylindrical and the outlet funnel 23 is connected sideways to the inlet funnel 22 in a slanting manner, i.e., the principal axes of the respective funnels are at a nonzero angle. The top surface of the throttling element 24 has a profiled edge 26 which operates in conjunction with the entry 27 of the outlet funnel 23, such that the rotation of the throttling element 24 closes the entry 27 either more or less according to the degree to which the profiled edge blocks the entry.

In the most preferred embodiment the motor 25 consists of a stepper motor and the cylindrical throttling element 24 is attached directly to the motor shaft 28.

Preferably, the edge 26 has such a shape that, in the device according to FIG. 1, the time of arrival at the detector 15 of the weft thread is obtained as a function of the rotation of stepper motor 25 for a certain setting of the pressure control 17. Very good results are obtained when using a throttling element 24 whose top surface has a shape as shown in FIG. 6. The top surface has an edge 26 consisting of a closing part 29, a first slanting part 30 connected to it, a second slanting part 31 with preferably a greater slope than the first part 30 and finally a passage part 32. When the closing part 29 is directed to the entry 27, the latter is in its maximum closed position. When the passage part 32 is directed to the entry 27, a full passage is obtained. In all intermediate positions the nozzle supply air is throttled to a greater or lesser extent.

The closing part 29 and the passage part 32 preferably extend over arcs L1 and L2, which are just large enough to make the closing part 29 and the passage part 32 operate in conjunction with the full passage of the entry 27. The first slanting part 30 extends over almost half the circumference, while the second slanting part 31 covers the remaining part of the circumference of the throttling element 24.

As indicated in FIGS. 7 and 8 the slanting parts 30 and 31 are preferably part of a surface slanting at an angle, 33 and 34 respectively. The course of the edge 26 thus obtained is shown in FIG. 9 in its unwound state.

It is clear that the influence of the throttling element 24 on the time of arrival of the weft thread 1 when the motor 25 is rotated can be modified by changing either of the four following parameters when constructing the throttling device 10, namely the diameter D1 of the outlet funnel 23 in a slanting position, the angle A between the inlet funnel 22 and the outlet funnel 23, the diameter D2 of the throttling element 24 and the above-mentioned shape of the edge 26. It must be noted that in the case where the cylindrical outlet funnel 23 connects to the inlet funnel 22 in a slanting manner, this results in the entry 27 of the outlet funnel 22 becoming elongated in the axial direction of the inlet funnel, with the advantage that the effect of the throttling is less subject to any possible tolerance deviations on the slanting parts 30 and 31 than if the outlet funnel 23 were perpendicular to the inlet funnel 22. It is clear that such an elongated opening can also be obtained by forming a groove at the entry 27, with the outlet funnel 23 not necessarily in a slanting position in relation to the inlet funnel 22.

In order to accurately achieve the linearity mentioned above through the shape of the edge 26, the diameter D2 of the throttling element 24 is preferably considerably larger than the diameter D1 of the outlet funnel 23. In order to obtain a maximum closing or opening respectively of the entry 27 of the outlet funnel 23, the closing part 29 and the passage part 32 must both have an arc. L1 and L2 respectively, equal to the arc L3 covered by the entry 27. This makes clear that the ratio D1/D2 must be large enough so that the arcs L1 and L2 do not cover too large a part, in terms of percentage, of the circumference of the throttling element 24 and so that large enough a length L4 remains to be used for the setting.

The throttling element 24 in FIG. 6 also offers the advantage that switching from minimum throttling to maximum throttling, and vice versa, can be done very fast because the closing part 29 and the passage part 32 are in each others immediate surroundings.

As indicated in FIG. 5, the step motor 25 can be fitted with a detection device 35 to define at least a start and/or end position, formed for example from an element 36 which is mounted on the motor shaft 28 and which operates in conjunction with the proximity detector 37.

In case of a device as indicated in FIG. 1, whereby the weft thread 1 is supplied by means of both a main nozzle 4 and an auxiliary main nozzle 5, according to the invention both the cutoff valve 9 and the throttling device 10 are placed in the common pipe 8, which eliminates the counter-productive effect of the two nozzles 4 and 5, which was mentioned in the introduction.

It must be noted that the part of the pipe 8 between the air receiver 18 and the throttling device 10 is kept as short as possible.

In order to realize the above-mentioned characteristics in practice, the cutoff valve 9 and the throttling device 10 are preferably made in one piece, which, for example as shown in FIG. 5, can be mounted against the wall of the air receiver 18. The cutoff valve 9 has the traditional construction and has a valve part 38 which can be moved by means of an electromagnet 39. The outlet funnel 23 mentioned above joins, preferably directly, the valve house of the cutoff valve 9.

Also according to the invention, the pipe 20 mentioned above which supplies low-pressure blow air, is connected downstream of the throttling device 10 to the nozzles 4 and 5, so that this weak airstream is not further throttled.

Although the invention is meant in the first place to control the main nozzle 4 and/or the auxiliary main nozzle 5, it is clear that it can also be used with reference to the supply of blow air to the relay nozzles 6.

The present invention is in no way limited to the embodiments described and shown in the drawings; on the contrary, such a device for supplying weft threads in weaving machines, can be made in various variants while still remaining within the scope of the invention.

We claim:

1. A device for supplying weft thread in airjet weaving machines, comprising at least one nozzle connected to a compressed air source; a buffer tank; a cutoff valve situated in a funnel between the compressed air source and the nozzle, said funnel comprising an inlet funnel and an outlet funnel connected to the inlet funnel; and a controlled throttling device mounted adjacent the cutoff valve and downstream of the buffer tank in respect to a direction of air supplied from the compressed air source through said funnel to said nozzle, said throttling device comprising said inlet funnel, said outlet funnel, a rotary throttling element situated in said inlet funnel, and means including a motor for rotating the throttling element to throttle said air supplied to said nozzle.

2. A device as claimed in claim 1, wherein said throttling device is situated upstream of the cutoff valve in respect to said direction of supplied air.

3. A device as claimed in claim 1, wherein the inlet funnel, the outlet funnel, and the throttling element constitute means for influencing a time of arrival of the weft thread at an end of the shed, and wherein a shape of the inlet funnel, a shape of the outlet funnel, and a shape of the throttling element determine the time of arrival as a function of the degree of rotation of the throttling element.

4. A device as claimed in claim 3, wherein the respective shapes of the inlet funnel, the outlet funnel, and the throttling element are such that said function is a linear function.

5. A device as claimed in claim 1, further comprising means defining an entry for passage of air into said outlet funnel, and wherein the throttling element is cylindrical and comprises means including a profiled edge of said throttling element for cooperation with said entry to throttle said supplied air by blocking passage of air from said inlet funnel through said entry.

6. A device as claimed in claim 5, wherein the throttling element is hollow.

7. A device as claimed in claim 5, wherein said entry is elongated, in an axial direction of the inlet funnel.

8. A device as claimed in claim 7, wherein the outlet funnel is cylindrical, and an axis of said outlet funnel intersects an axis of the inlet funnel at a nonzero angle.

9. A device as claimed in claim 5, wherein the throttling element has a top surface, and wherein an edge along a circumference of the throttling element is formed successively of a closing part, a first slanting part, a second slanting part having a slope which is steeper than a slope of the first slanting part, and means defining a passage part for allowing a completely free passage of supplied air from the inlet funnel to the outlet funnel when the throttling element is rotated to a non-throttling position.

10. A device as claimed in claim 9, wherein the first slanting part and the second slanting part form edges of different flat surfaces.

11. A device as claimed in claim 3, wherein the throttling element includes an edge whose shape is such that said function is a linear function.

12. A device as claimed in claim 1, wherein said motor is a stepper motor.

13. A device as claimed in claim 1, wherein said motor comprises means including a detection device for defining a reference position of said motor.

14. A device as claimed in claim 1, wherein said at least one nozzle includes a moving main nozzle, a fixed main nozzle, and common air supply means for supplying air to said moving and fixed main nozzles, said common air supply means including a common supply pipe in which said cutoff valve is mounted.

15. A device as claimed in claim 1, further comprising means including a low-pressure supply pipe for supplying low-pressure air to hold thread ends in said at least one nozzle, and wherein said low-pressure supply pipe is connected downstream of the cutoff valve and the throttling device to a main supply pipe connected between the outlet funnel and the nozzle.

16. A device as claimed in claim 1, further comprising means for supporting the cutoff valve and the throttling device as part of an integral unit.

* * * * *